US006669046B1

(12) United States Patent
Sawada et al.

(10) Patent No.: US 6,669,046 B1
(45) Date of Patent: Dec. 30, 2003

(54) FOOD CONTAINER LID MEMBER HAVING SELECTIVELY PEELABLE AREA

(75) Inventors: Kiyoshi Sawada, Osaka (JP); Mitsuo Yoshimura, Osaka (JP); Kyutaro Ikeda, Shiga (JP); Hirofumi Kawai, Osaka (JP)

(73) Assignee: Nissin Shokuhin Kabushiki Kaisha, Osaka (JP)

( * ) Notice: Subject to any disclaimer, the term of this patent is extended or adjusted under 35 U.S.C. 154(b) by 0 days.

(21) Appl. No.: 09/806,331

(22) Filed: Jun. 14, 2001

(30) Foreign Application Priority Data

Sep. 30, 1998 (JP) ..... 10-278288
Dec. 21, 1998 (JP) ..... 10-362413
Feb. 10, 1999 (JP) ..... 11-326685

(51) Int. Cl.[7] ..... B65D 17/34

(52) U.S. Cl. ..... 220/270; 220/359.2; 220/359.3; 220/359.4; 229/125.35; 426/115; 426/122; 428/43

(58) Field of Search ..... 426/122, 115; 229/120, 125.35; 220/359.4, 359.3, 359.2, 271, 270, 266, 367.1; 428/40.1–42.3, 43, 134, 136, 131, 137, 138

(56) References Cited

U.S. PATENT DOCUMENTS 3,154,225 A * 10/1964 Wadlinger et al.
4,020,969 A * 5/1977 Ando ..... 220/359.2
4,209,126 A 6/1980 Elias
4,530,440 A * 7/1985 Leong ..... 220/201
4,636,273 A * 1/1987 Wolfersperger ..... 156/244.11
4,735,335 A * 4/1988 Torterotot ..... 220/270
4,771,937 A 9/1988 Kamada et al.
5,125,529 A * 6/1992 Torterotot ..... 220/270
5,851,333 A * 12/1998 Fagnant et al. ..... 220/359.3

FOREIGN PATENT DOCUMENTS

JP 56-28154 Y2 7/1981
JP 57-55175 Y2 11/1982
JP 60-9171 Y2 4/1985
JP 61-3810 Y2 2/1986
JP 61-287571 12/1986
JP 2-282074 11/1990
JP 8-337274 12/1996
JP 2000-327013 * 11/2000

OTHER PUBLICATIONS

International Search Report of PCT/JP99/05309.
English Translation of International Preliminary Examination Report of PCT/JP99/05309.
International Search Report of PCT/JP99/06890.

* cited by examiner

*Primary Examiner*—Robin A. Hylton
(74) *Attorney, Agent, or Firm*—Marshall, Gerstein, Borun LLP

(57) ABSTRACT

A lid member for a food container comprising an easily-peelable area of the layered structure having a lubricant between the base layer and the surface sheet, a non-peelable opening area of the layered structure disposed within the easily-peelable area; a non-peelable area of the layered structure disposed adjacent to easily-peelable area, said lid member further comprising a first tab to peel off the lid member from the container body, a second tab formed on the easily-peelable area along the boundary line between the non-peelable area and the easily-peelable area to open the apertures of the opening area, a first slit, cut from the base layer to the adhesive layer forming apertures in the opening area, a second slit, cut from the surface sheet to the adhesive layer, along the boundary line between the easily-peelable area and non-peelable area, and a third slit, cut from the base layer to the adhesive layer and disposed where the second tab is mounted, from a foot-end of the second tab, spaced from the second slit, to a cross position with the second slit.

15 Claims, 8 Drawing Sheets

PRIOR ART

PRIOR ART

FOOD CONTAINER LID MEMBER HAVING SELECTIVELY PEELABLE AREA

FIELD OF THE INVENTION

The present invention relates to a lid member for food container, more particularly, to an improvement of a lid member to be used for containers for quickly cookable foods.

BACKGROUND OF THE INVENTION AND PRIOR ART

Conventionally, quickly cookable foods like chow mein, spaghetti, polished rice and sekihan (steamed rice with red beans) or the like have been distributed as a sort of quickly cookable foods to be cooked by pouring thereinto hot water, leaving it for a predetermined time and removing therefrom the hot water.

As the containers for quickly cookable foods to be cooked by removing such poured hot water, their popular structure have a cup-shaped container body and plastic lid member mounted thereon. Container bodies for such containers were usually produced by thermoforming expanded resin particles (expandable resin beads) made of polystyrene resins and a blowing agent like butane, pentane or the like. Then, the popular plastic lid members are sheet-formed and have discharge apertures at their outer circumference. These plastic lid members are simply to cover the container body, more particularly, the lid member is engaged with the container body through their projections by engaging such projections with grooves provided on the flange at the outer circumference of the lid member.

With reference to FIG. 7, the conventional plastic lid member 100 has a pair of apertures in mutually opposite positions at the lid circumferential edge. These apertures are to discharge the poured hot water from the container body and have slit blade a. When the blade a is stood up, apertures to discharge the hot water from the container are formed.

However, numbers of such apertures to be formed at a restricted area in the flange are limited, therefore, the discharge rate of the hot water is accordingly limited, thus, it usually takes a longer time to remove the hot water. Then, when apertures are blocked by the foods in the container, a still longer time will also be necessary to remove the hot water. Further, when the blade a is broken, their fragments might enter the container. Further, sealability of the container is not good, thereby, moisture might penetrate into the container through the space formed by standing up blade a and space formed between the lid and the container covered thereby.

In addition thereto, since most of such conventional lid members 100 were sheet-formed products, when the container body is covered therewith, the size of the container became unfavorable due to their bulk, and further space was necessary in transportation or storage thereof.

Further, in consideration of the consumers' interest expressed and increased recently on an environmental issue, it is not preferable to dump these plastic lid members.

Then, when such containers were not handled well during the discarding of the hot water, the lid member is disconnected from the container body, and food stuff together with hot water will then be spilled therefrom. Accordingly, there is a potential danger of suffering from burning, and it is necessary to securely hold both of the container and the lid member during such discharging step.

Incidentally, Japanese Utility Model Publication No. 61-3810 (Prior Art) discloses a container for quickly cookable foods utilizing a lid member made of paper. This utilizes paper as a base layer and is to stick to the opening of the container.

With reference to FIG. 8, lid member 200 has substantially the same circumference size with that of the opening in the container body, then the discharge apertures 204 appear on the surface of the lid by pulling up the tab 203 integrally formed on the member 200.

The lid member 200 is formed by laminating polyethylene, aluminum foil or the like onto the base paper. In the container wherein the lid member 200 is stuck to the container body, the discharge apertures 204 are formed by pulling up the tab 203 integrally formed on the lid member 200, then, the easily-peelable area D is separated from the slit linking both foot-ends b, b around the tab 203.

The lid member 200 according to the prior art is more suitable to seal the container than the conventional lid member 100 (FIG. 7), and it reduces the bulk of the container; thereby, they are easily manufactured and dumped. According to this structure, however, the tab 203 may be broken at the slit linking both ends b, b when the tab 203 is pulled.

Then, the tab 203, positioned opposite to the tab 202, is placed around the center in the circumferential edge of the easily-peelable area D, therefore, it is necessary to pull up the tab 203 to open the apertures, such that the pulling force should be applied radially and equally toward the tab 203 as a center. Accordingly, considerable force and knack were necessary to separate the easily-peelable area D, thereby, the tab 203 itself may be broken at such peeling step.

In view of such inconveniences in the prior art, the present invention is to provide a lid member for a container of quickly cookable foods which can discharge hot water, in particular, it has excellent sealability with a container body, it allows the discharge of hot water safely and rapidly, its discharging apertures are easily formed, and it can be easily disposed of as waste.

SUMMARY OF THE INVENTION

With reference to FIGS. 1 and 2, a lid member for food container (hereinafter simply referred to as "lid member") according to the present invention which can discharge hot water is a lid member 1 wherein it has substantially the same circumference as that of an opening 15 and will be stuck to the opening 15 of a container body 14, and it has a layered structure in which a base layer 20 and a surface sheet 40 are laminated through an adhesive layer 30.

The lid member 1 has an easily-peelable area A of the layered structure, having lubricant 11 additionally between the base layer 20 and the surface sheet 40; a non-peelable opening area C of the aforenoted layered structure placed within the easily-peelable area A; a non-peelable area B of the aforenoted layered structure placed adjacent to the easily-peelable area A; and the lid member further has:

- a first tab 2 to peel off the lid member 1 from the container body 14, and
- a second tab 3 formed at the side on the easily-peelable area A along the boundary line between the non-peelable area B and the easily-peelable area A to open the discharge apertures of the opening area C by peeling off from the lid member 1 a surface sheet in the easily-peelable area A.

Then, the lid member 1 comprises a series of slits 4–6, wherein:

a first slit 4 which is cut from the base layer 20 to the adhesive layer 30 and forms discharge apertures in the opening area C, a second slit 5, which is cut from the surface sheet 40 to the adhesive layer 30, along the boundary line between the easily-peelable area A and non-peelable area B, and a third slit 6, which is cut from the base layer 20 to the adhesive layer 30 and is placed where the second tab 3 is mounted, from the foot-end d of the second tab 3 spaced from the second slit 5 to the cross position e with the second slit 5.

According to the lid member of the present invention, the surface sheet in the easily-peelable area A can be easily and securely peeled along with the second slit 5 by pulling up the second tab 3, thereby, a desired number of discharge aperture(s) can be formed.

According to the other embodiment of the present invention, with reference to the FIG. 1(B), a lid member is arranged so that at least a part of the third slit 6 in the lid member 1 is placed on the sticking portion 17 substantially corresponding to the circumferential edge of the opening 15. In this case, preferably, the cross position e by the second slit 5 and the third slit 6 is placed on the sticking portion 17.

By thus arranging the third slit 6, since the surface sheet 40 can be peeled smoothly from the base layer 20 along the third slit 6 while the second tab 3 can also be peeled completely, the second tab 3 can easily be pulled.

According to the another embodiment of the present invention, with reference to FIG. 4(A), a lid member can be arranged so that the second slit is at least one slit zone 50 wherein a pair of discontinuous slits, inclined mutually outwardly, make a row along the boundary line and between the easily-peelable area A and the non-peelable area B.

Thus, when the second slit is the slit zone 50, since the second tab 3 breaks the slit zone 50 going through the adjacent slits successively, the surface sheet 40 in the easily-peelable area A can easily be separated, and the discharge apertures can also be opened more smoothly.

According to the another embodiment of the present invention, with reference to FIG. 5, a notch 18 is formed around the second tab 3 and is formed from the circumferential edge of the lid member to the second slit 5 (the slit zone 50) or to around the second slit 5.

Thereby, by pulling up the second tab 3, after the notch 18, the third slit 6 and the second slit 5 (the slit zone 50) are broken, in this order, and the surface sheet 40 in the easily-peelable area A is peeled from the base layer 20.

In particular, when the notch 18 is formed from the circumference edge of the lid member to the cross position e (See FIG. 3) by the second slit 5 and the third slit 6, peeling of the easily-peelable area A with the second tab 3 would be remarkably easy.

DETAILED DESCRIPTION OF THE PREFERRED EMBODIMENTS

Detail of the present invention will be described as follows.

Figure 1A:
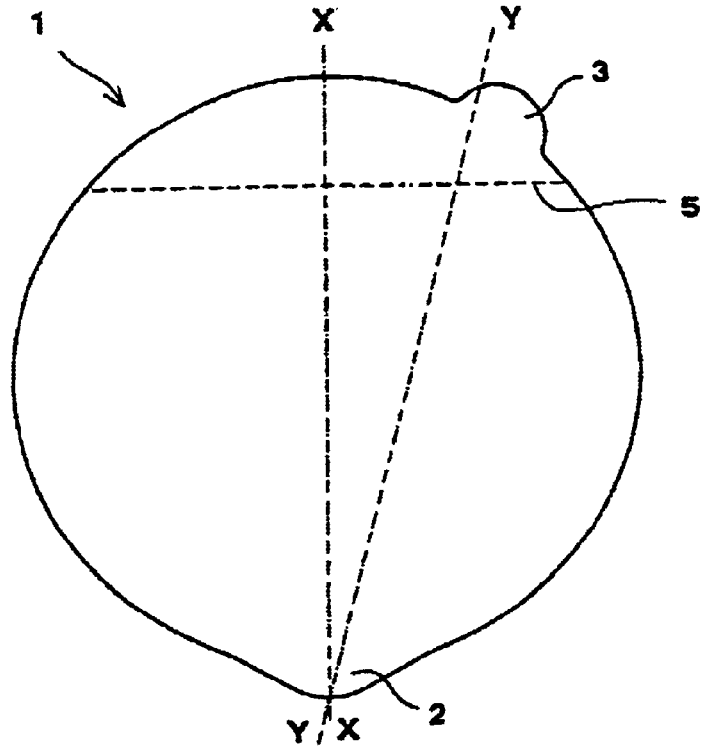
FIGS. 1(A) and (B) respectively show a plan view and a back view of the lid member according to an embodiment of the present invention.
Figure 1B:
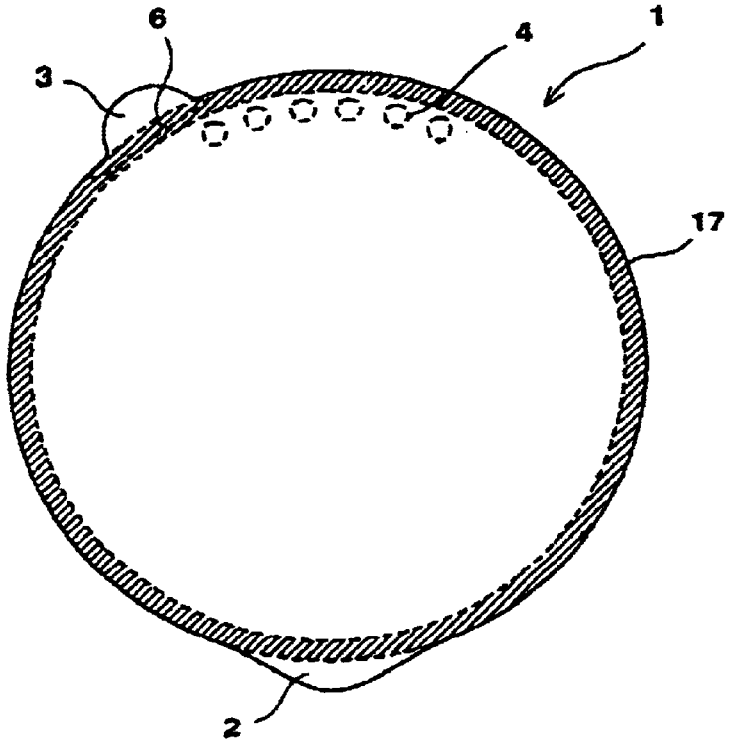
Figure 2A:
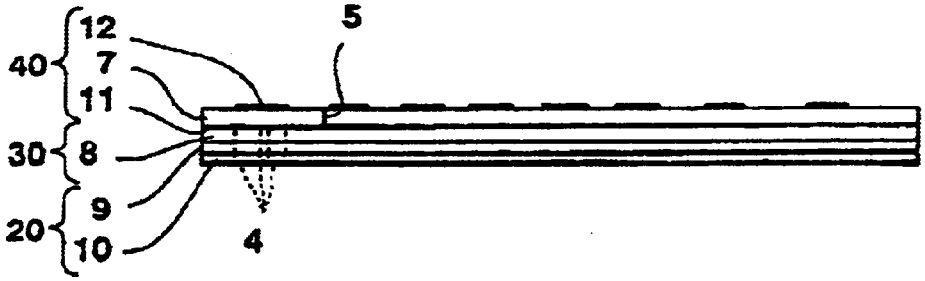
FIGS. 2(A) and (B) respectively show a cross sectional view taken along the lines X—X and Y—Y in the FIG. 1.
Figure 2B:
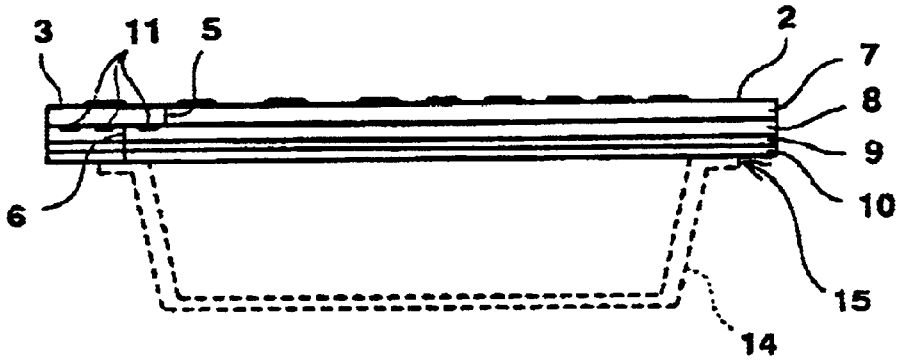
Figure 3:
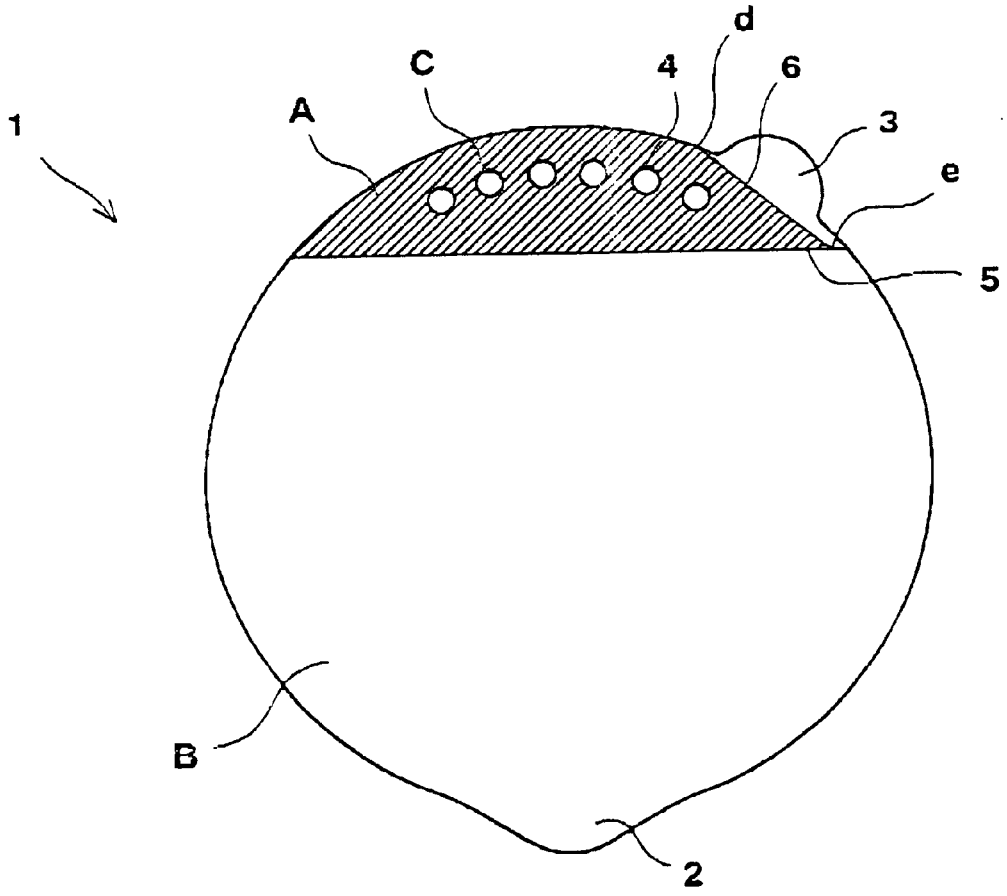
FIG. 3 is a schematic view showing the area (A) to (C) appeared on the surface of the lid member according to an embodiment of the present invention.

With reference to FIGS. 1–3, in general, a lid member of the present invention is the lid member 1 comprising a layered structure in which the base layer 20 and the surface sheet 40 are laminated through an adhesive layer 30; in other words, the lid member 1 is stuck to the opening 15 of the container body of a food container and has substantially the same circumferential edge as that of the opening 15.

The interlayer between the base layer 20 and the surface sheet 40 of the lid member 1 is sectioned into the easily-peelable area A having the layered structure in which the lubricant 11 is further applied to facilitate to peel the base layer 20 from the surface sheet 40, the non-peelable opening area C to form the apertures to discharge the hot water placed in the easily-peelable area A, and the non-peelable area B positioned adjacent to the easily-peelable area A.

Both the opening area C and the non-peelable area B have the aforenoted layered structure wherein the base layer 20 and the surface sheet 40 are arranged so that they can not be peeled from each other.

Then, the first slit 4 is formed in the opening area C which cuts from the base layer 20 to the adhesive layer 30. It is preferably that transverse cross-section to be made by the first slit 4 should be a little larger than that of the opening region C.

Then, the circumferential edge of the lid member has at least two tabs—a first tab 2 to peel the lid member 1 from the container body 14, and a second tab 3 to form the apertures to discharge the hot water in the opening area C by peeling the surface sheet in the easily-peelable area A of the lid member 1. The first tab 2 is preferably provided on the non-peelable area B, while the second tab 3 is usually provided at the side of the easily-peelable area A and adjacent to a boundary line between the non-peelable area B and the easily-peelable area A. Lid member 1 can have one or more first tab(s) 2, while, with regard to the second tab 3, it can have one or two tab(s) 3 when the lid member 1 has single second slit 5.

Further, the second slit 5, which cuts from the base layer 20 to the surface sheet 40, is formed in a straight line, substantially along the boundary line between the easily-peelable area A and the non-peelable area B which is adjacent to the area A and on such boundary line or in the easilypeelable area A.

And, the third slit 6, which cuts from the base layer 20 to the adhesive layer 30, is formed around the second tab 3 and from the circumferential edge d of the lid member (one of foot-ends of the second tab 3) spaced from the second slit 5 to the cross position e by the second slit 5.

Then, with reference to FIG. 1(B), the sticking portion 17 of the lid member 1 is provided at a position to be contacted with the opening of the container body, and the width of an adhesion zone in the sticking portion 17 is usually 1–10 mm. Preferably, a part of the third slit 6 is placed on the sticking portion 17. Specifically, the cross position e by the second slit 5 and the third slit 6 is preferably placed on the sticking portion 17. Meanwhile, these slits 4, 5 and 6 may either be continuous liner slits or discontinuous slits, such as perforated slits.

Figure 4A:
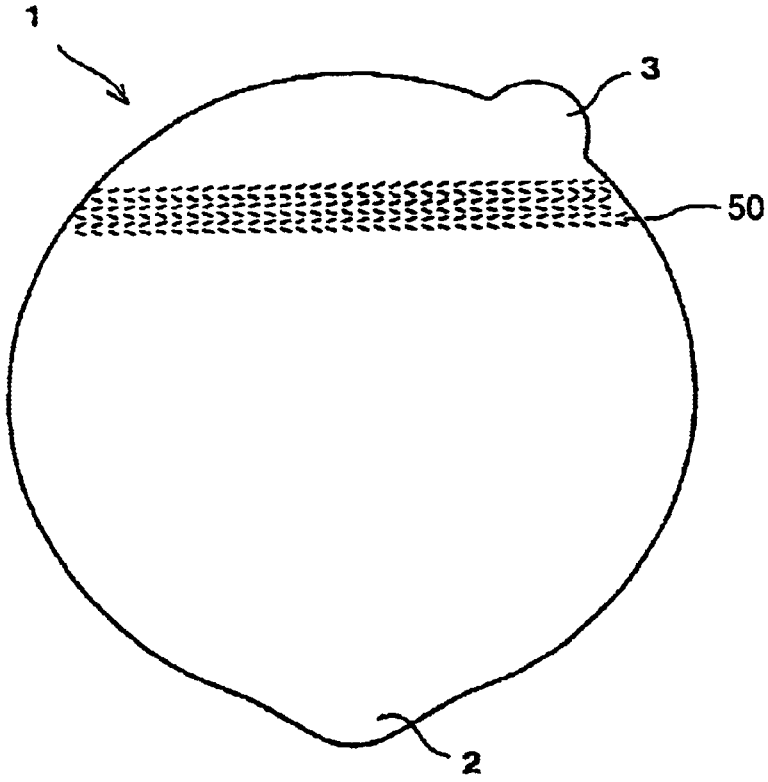
FIGS. 4(A) and (B) respectively show a plan view and a partially enlarged view of the lid member according to another embodiment of the present invention.
Figure 4B:
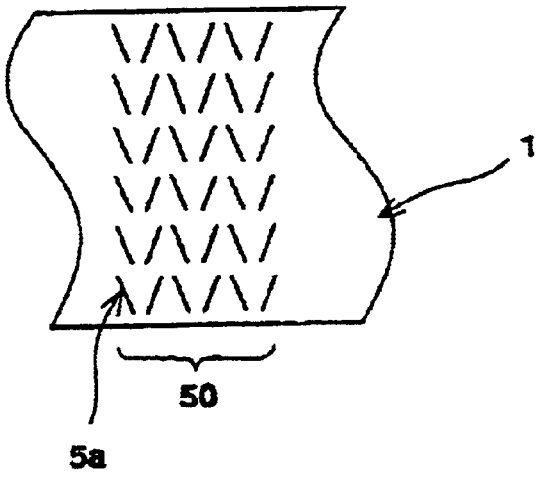

The second slit 5 may be the slit zone 50 as illustrated in FIG. 4. In this case, with reference to FIG. 4, the slits 5*a* are arranged in rows as discontinuous pairs of slits which are mutually angled outwardly and have an angle of inclination of approximately 20 degree on the peeling direction (pull direction). Slits 5*a* may be arranged as two or more rows. Then, when the slits 5*a* are formed as discontinuous pairs of slits which are mutually angled outwardly and are arranged symmetrically, slits can be broken easily, and fragments of the base layer at the broken sites can also be prevented. Although the slits 5*a* may be arranged in two or more rows, for ideal peeling, it is preferable to arrange the slits 5*a* in three to five rows. In this case, preferably, the slit zone 50 is formed on the boundary line between the easily-peelable area A and the non-peelable area B.

Figure 5:
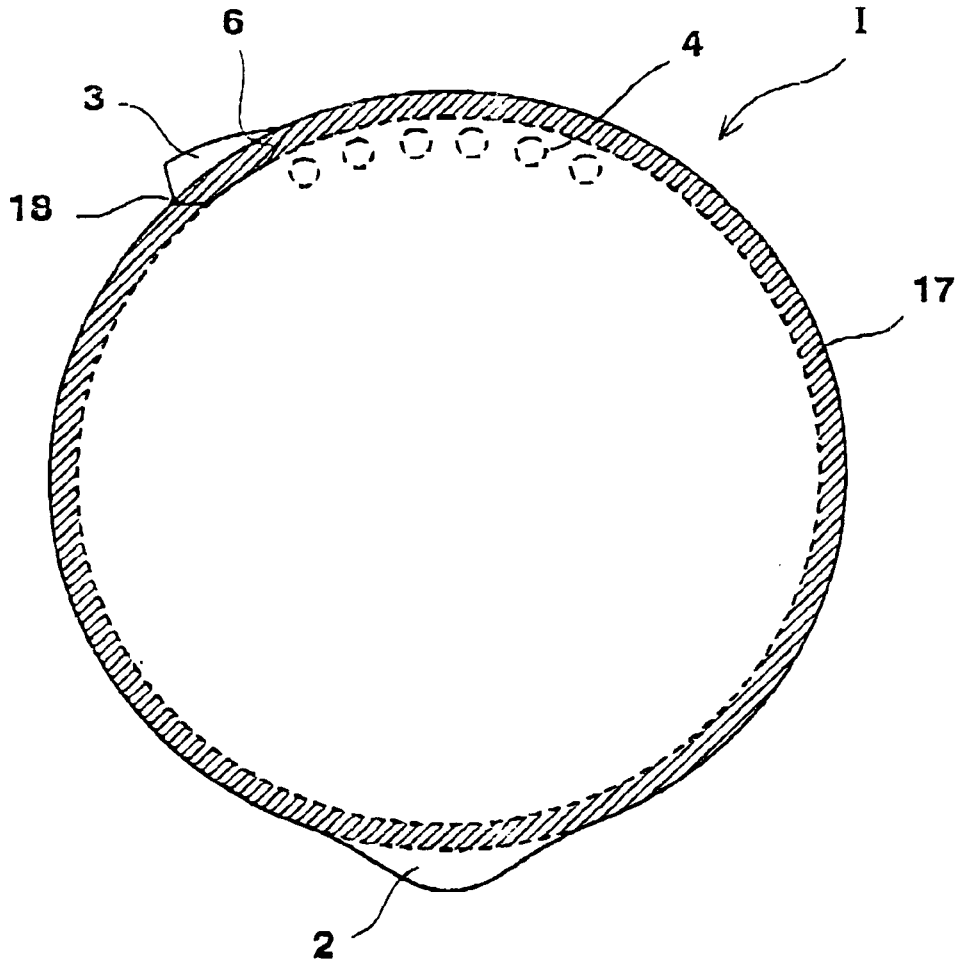
FIG. 5 shows a back view of the lid member according to an another embodiment of the present invention.

As illustrated in FIG. 5, a notch 18 may further be provided on the second slit 5 (the slit zone 50) or adjacent thereto within the circumferential edge of the lid member. In this case, the notch 18, which cuts from the surface sheet 40 to the base layer 20, is provided such that a slit of several millimeters in length from the circumferential edge of the lid member is laid from the circumferential edge of the lid member 1 to the second slit 5. And, preferably, the notch 18 is arranged to lie from the circumferential edge of the lid member to the third slit 6 (the cross position e in FIG. 3) on or along the second slit 5. Meanwhile, if the notch 18 is simultaneously prepared with a knife to make the second slit 5 or the third slit 6, the mutual position can be adjusted.

The present lid member will then be explained along with production method thereof.

As the base layer 20, any layered structure prepared by extruding sealant 10 onto the aluminum foil 9 is applicable. As the sealant 10, any sealant which is easily peeled from the container body 14 made from a resin such as expanded styrene, styrene, and polypropylene is applicable, and includes, for example, those having cold adhesion, such as an olefin resin, such as ethylene vinyl acetate (EVA), a polyolefin resin, such as ethylene vinyl alcohol acetate (EVOH) or heat seal varnish may be used.

As the surface sheet 40, paper 7 of 60 g/m$^2$ thickness or more, in particular, coat paper of about 60 to about 150 g/m$^2$ thickness is applicable. Both sides of the paper 7 are processed according to the identical step in the gravure printing method, whereby printing layer 12 with ink coated on the front side, and lubricant 11 (thickness of about 0.2 to about 20 $\mu$m) containing a mixture of an edible surfactant agent such as lecithin, digestive cotton adhesive, wax or silicon or the like is coated on the area corresponding to the easily-peelable area A in the back side.

Further, for the adhesive layer 30, adhesive 8 which is excellent in heat bonding at the surface coated by the lubricant 11, in particular, polyethylene, ethylene methacrylic acid (EMA) or the like is applicable.

Laminated products having a layered structure [of base layer 20—adhesive layer 30—surface sheet 40] can be produced by laminating, with an extruder, the base layer 20, the surface sheet 40 and the adhesive layer 30 sandwiched therebetween. Each of the slits and the notch were provided with or without previously cutting the laminated products into leaf-like form, then the lid member 1 is produced through a clicking process with or without minutely cutting them previously. Each of the slits and the notch are simultaneously formed at the minute cutting step or the drawing process. Each slit can be formed respectively in a separate process.

For example, the second slit 5 (the slit zone 50) can be made on the surface sheet 40 prior to the lamination. Likewise, the slits 4 and 6 can also be made prior to the lamination. In this case, however, the slits 4, 5 and 6 have to be cut in the form of the perforated line (not in a continuous line).

The lid member 1 so produced is stuck to the opening 15 of food container 14 by means of a heat seal or the like.

As the food container 14, container made from various kinds of materials including expanded styrene, styrene, polypropylene and paper can be used.

A method of using a container employing the lid member of the present invention will be described as follows.

First of all, the first tab 2 is pulled up, then one third of the lid member 1 is peeled toward the opposite direction from the opening 15, and hot water is poured into the container body 14.

Figure 6:
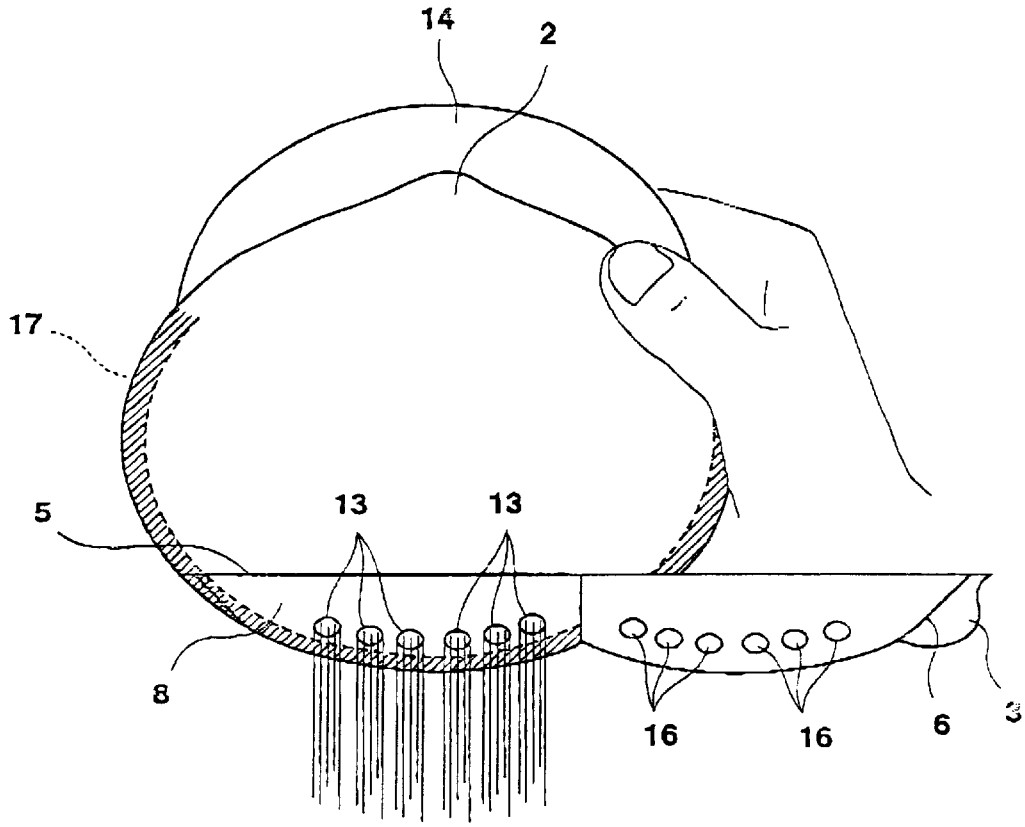
FIG. 6 is a perspective view showing how to use a food container employing the lid member according to an embodiment of the present invention.
Figure 7:
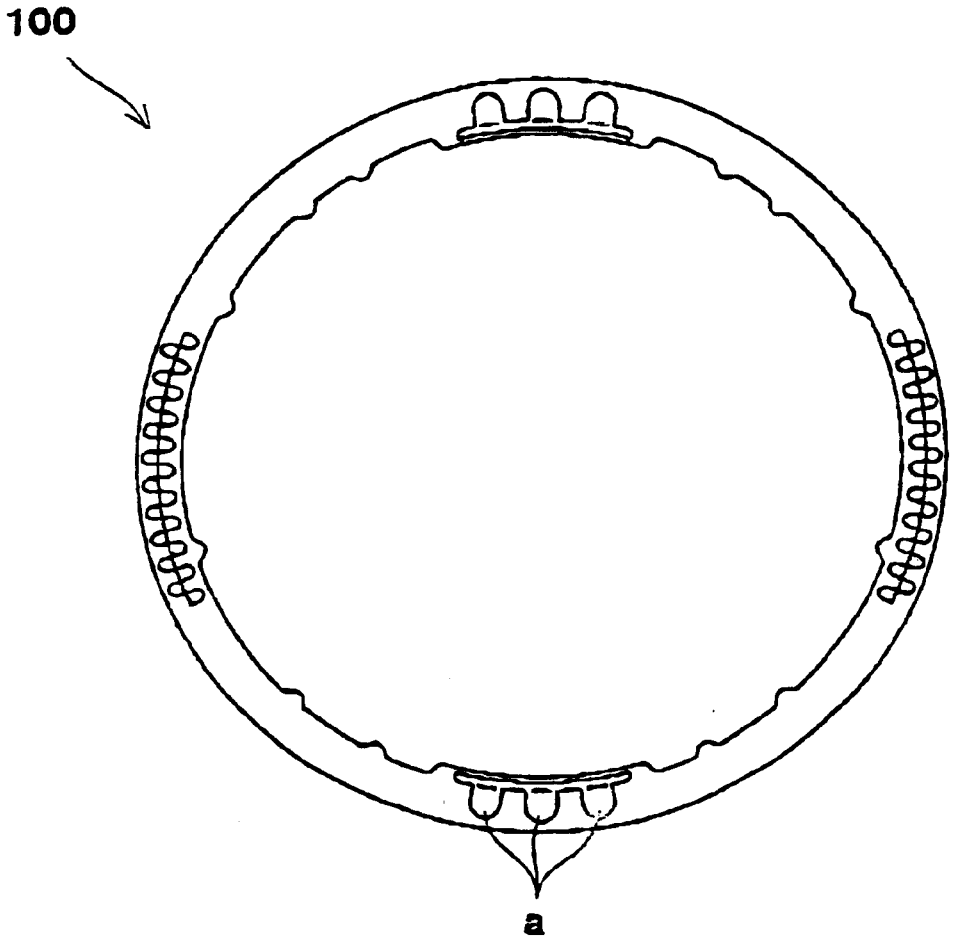
FIG. 7 shows a plan view of the conventional plastic lid member.
Figure 8:
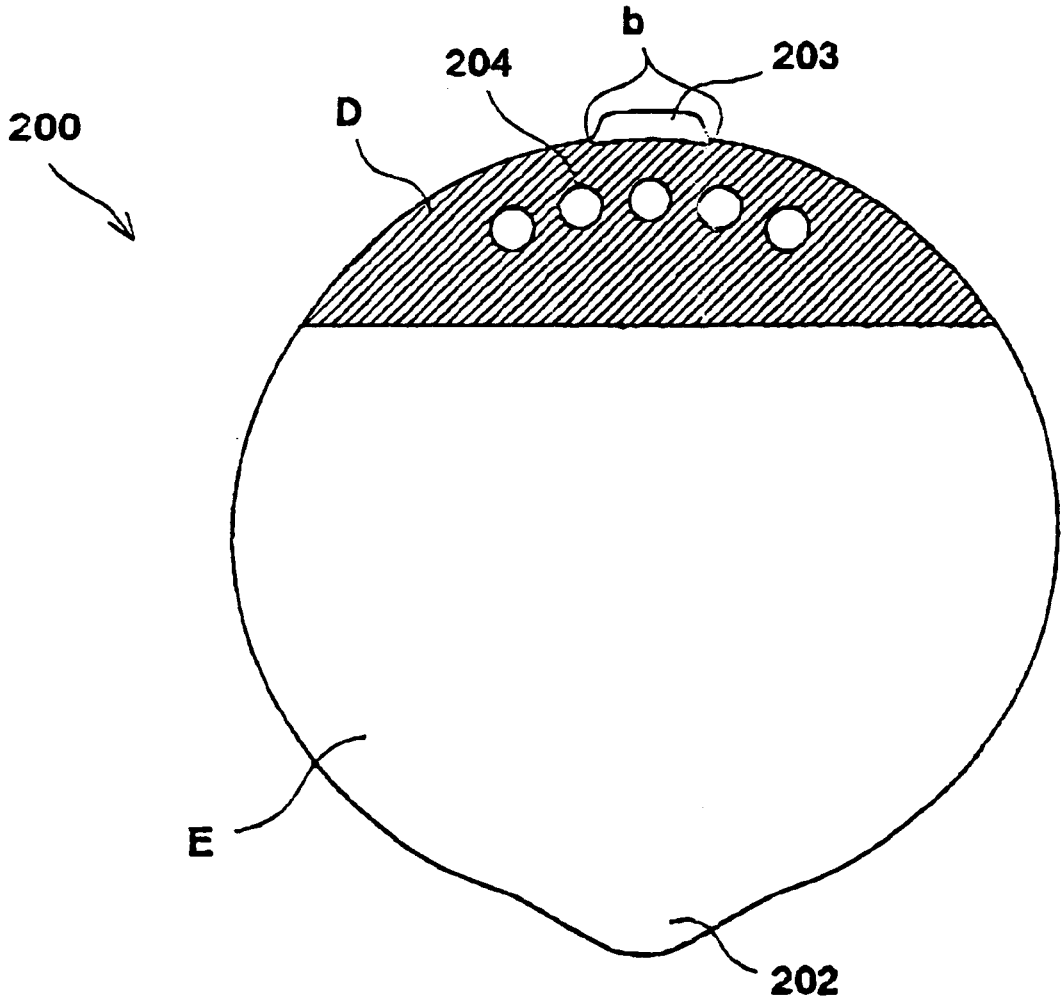
FIG. 8 shows a plan view of the conventional paper lid member.

Next, the first tab 2 is bent over a circumferential edge of the container body 14 to reseal the container, and it is left for a determined time. After then, the easily-peelable area A is peeled (the fragment 16 is removed) by pulling up the second tab 3, then the apertures 13 are opened, and unnecessary hot water is discarded, as illustrated in FIG. 6.

EXAMPLE 1

The base layer 20 was produced by applying sealant 10 (25 $\mu$m thickness) made from cold adhesive EVA (olefin resin) to aluminum foil 9 (15 $\mu$m thickness). On the other hand, rolled paper 7 (coated paper: 84.9 g/m$^2$) was processed according to an identical step in a gravure printing method, whereby the printing layer 12 with ink was coated on the front side, and lubricant 11 prepared by mixing an edible surfactant agent with silicon was coated on the back side, thereby, the surface sheet 40 was produced.

Next, laminated products having layered structure [of base layer 20—adhesive layer 30—surface sheet 40] were produced by laminating, with an extruder, the base layer 20, the surface sheet 40 and the heated polyethylene adhesive 8 (adhesive layer 30 with thickness of 15 $\mu$m thickness) sandwiched therebetween.

Then, slits and notch were provided by cutting the laminated products into leaf-like form, then the lid member 1 was produced through a minute cutting and drawing process.

The third slit 6 was arranged such that at least a part of the slit 6 is laid on the sticking portion 17, and the third slit 6 is laid from the circumferential edge d (one of foot-end d of the second tab 3) adjacent to the second tab 3 spaced from the second slit 5 to the cross position e (about 3 mm inside from the outer circumference) by the second slit 5 (See FIG.3).

This lid member was stuck to the sticking portion 17, in a 4 mm width, of the cup-shaped container body made of polystyrene paper.

Thus, a container for quickly cookable foods (the container for quickly cookable noodles) according to the present example was produced.

As illustrated in FIGS. 2 and 3, slits according to this example included a circularly perforated line employed as the first slit 4 and straight line slits employed as the second and the third slits 5 and 6.

EXAMPLE 2

Laminated products were produced according to the procedures same to those in Example 1 except that EVOH was used as the sealant 10, then slits were provided by cutting them into leaf-like form, and the lid member 1 was produced through a minute cutting and drawing process.

This lid member was stuck with heat-fusing to the cup-shaped container body made of polystyrene paper.

Continuous curve slits were employed as the first slits 4 and 6, and the slit zone 50 consisting of slits 5*a* inclined to mutually look outwardly were employed as the second slit 5 as illustrated in FIGS. 4(A) and (B).

Thus, a container for quickly cookable foods (the container for quickly cookable noodle) according to the present example was produced.

According to the lid member of the present invention, any desired number of apertures can be formed, thereby, blockage of the apertures by the foods in the container are prevented, and the hot water can rapidly be removed. Then, since the fragments of the lid member to be made at the forming of the apertures are adhered and peeled with the back surface of the surface sheet as an opening area in the non-peelable area B, any fragment (blade) should not enter the container, thereby, a sanitory lid member would be provided.

Lid member according to the present invention is formed by layered products consisting mainly of paper, therefore, bulk of container at transportation or storage are reduced, then, compact and aesthetic lid members and containers can be provided.

Further, sealability of the container is improved by heat-sealing the lid member to the container body, thereby, spilling the contents is effectively prevented when the hot water is discarded from the container.

In addition, the lid member according to the present invention may be disposed of as combustibles and as garbage.

Then, the lid member according to the present invention will eliminate breaks of the tab to open apertures for discharging hot water, which are problems in the conventional paper lid member, and provide a container for quickly cookable foods in which the surface sheet can be smoothly peeled.

Further, according to the lid member of the present invention, the surface sheet will be peeled more correctly and easily by providing the notch on the circumferential edge of the lid member and using it as an origin for peeling the surface sheet.

What is claimed is:

1. A lid member for a food container having substantially the same circumference as that of an opening of a container body in a food container and having a layered structure in which a base layer and a surface sheet are laminated through an adhesive layer, wherein the lid member comprises:

an easily-peelable area of the layered structure having a lubricant between the base layer and the surface sheet, a non-peelable opening area of the layered structure disposed within the easily-peelable area; a non-peelable area of the layered structure disposed adjacent to the easily-peelable area, said lid member further comprising:

a first tab to peel off the lid member from the container body, a second tab formed on the easily-peelable area along a boundary line between the non-peelable area and the easily-peelable area to form the apertures of the opening area, a first slit, cut from the base layer to the adhesive layer forming the apertures in the opening area, a second slit, cut from the surface sheet to the adhesive layer, along the boundary line between the easily-peelable area and the non-peelable area disposed adjacent to the easily peelable area, and a third slit, cut from the base layer to the adhesive layer and disposed where the second tab is mounted, at a foot-end of the second tab, and extending from a spaced from the second slit, to a cross position with the second slit.

2. The lid member according to claim 1, wherein at least a part of said third slit is disposed on a sticking portion on a circumferential edge of the opening.

3. The lid member according to claim 1, wherein the cross position of said second slit and said third slit is disposed on a sticking portion on a circumferential edge of the opening.

4. The lid member according to claim 2, wherein the cross position of said second slit and said third slit is disposed on the sticking portion.

5. The lid member according to claim 1, wherein said second slit is a slit zone comprising at least one row of pairs of discontinuous slits inclined mutually outwardly.

6. The lid member according to claim 2, wherein said second slit is a slit zone comprising at least one row of pairs of discontinuous slits inclined mutually outwardly.

7. The lid member according to claim 3, wherein said second slit is a slit zone comprising at least one row of pairs of discontinuous slits inclined mutually outwardly.

8. The lid member according to claim 1, wherein said lid member includes a notch on said second slit, or adjacent thereto, within the circumferential edge of the lid member and adjacent to said second slit.

9. The lid member according to claim 2, wherein said lid member includes a notch on said second slit, or adjacent thereto, within the circumferential edge of the lid member and adjacent to said second slit.

10. The lid member according to claim 3, wherein said lid member includes a notch on said second slit, or adjacent thereto, within the circumferential edge of the lid member and adjacent to said second slit.

11. The lid member according to claim 4, wherein said lid member includes a notch on said second slit, or adjacent thereto, within the circumferential edge of the lid member and adjacent to said second slit.

12. The lid member according to claim 8, wherein said notch is formed, on or along said second slit, from the circumferential edge of the lid member to the cross position by said third slit.

13. The lid member according to claim 9, wherein said notch is formed, on or along said second slit, from the circumferential edge of the lid member to the cross position by said third slit.

14. The lid member according to claim 10, wherein said notch is formed, on or along said second slit, from the circumferential edge of the lid member to the cross position by said third slit.

15. The lid member according to claim 11, wherein said notch is formed, on or along said second slit, from the circumferential edge of the lid member to the cross position by said third slit.

* * * * *

UNITED STATES PATENT AND TRADEMARK OFFICE

CERTIFICATE OF CORRECTION

PATENT NO. : 6,669,046 B1
DATED : December 30, 2003
INVENTOR(S) : Sawada et al.

It is certified that error appears in the above-identified patent and that said Letters Patent is hereby corrected as shown below:

Title page,
Item [22], please delete "Filed: Jun. 14, 2001" and replace with
-- PCT Filed: Sep. 29, 1999 --.
Item [86], please add: -- PCT NO.: PCT/JP99/05309
§371 (c)(1)
(2), (4) Date: Jun. 14, 2001 --.
Item [87], please add -- PCT Pub. No.: WO 00/18657
PCT Pub. Date: Apr. 6, 2000 --.
Item [30], Foreign Application Priority Data, please delete "11-326685" and replace with -- 11-32685 --.

Signed and Sealed this

Twenty-fifth Day of May, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,669,046 B1
DATED : December 30, 2003
INVENTOR(S) : Kiyoshi Sawada et al.

It is certified that error appears in the above-identified patent and that said Letters Patent is hereby corrected as shown below:

Column 8,
Lines 10-11, please delete "spaced from the second slit…" and replace with -- spaced position form the second slit… --.

Signed and Sealed this

Third Day of August, 2004

JON W. DUDAS
*Acting Director of the United States Patent and Trademark Office*